United States Patent [19]

Bradley et al.

[11] Patent Number: 4,710,138

[45] Date of Patent: Dec. 1, 1987

[54] ELECTRICAL CONNECTOR APPARATUS

[75] Inventors: James D. Bradley, Mound; George B. Pfeffer, Minnetonka, both of Minn.

[73] Assignee: ADC Telecommunications, Inc., Minneapolis, Minn.

[21] Appl. No.: 936,181

[22] Filed: Dec. 1, 1986

[51] Int. Cl.[4] ..... H01R 17/18

[52] U.S. Cl. ..... 439/581; 439/874; 439/63

[58] Field of Search ..... 339/94, 60, 177, 252, 339/255, 256, 258, 275 R, 278 C, 136–141, 114–116

[56] References Cited

U.S. PATENT DOCUMENTS

| | | | |
|---|---|---|---|
| 3,617,990 | 11/1971 | Colardeau | 339/278 C |
| 3,683,331 | 8/1972 | Overholser | 339/114 |
| 3,958,851 | 5/1976 | Evans | 339/177 E |
| 4,260,181 | 4/1981 | Curtin | 285/21 |
| 4,452,503 | 6/1984 | Forney, Jr. | 339/177 R |
| 4,609,242 | 9/1986 | Kemppainen | 339/177 R |
| 4,611,873 | 9/1986 | Punako et al. | 339/177 R |
| 4,628,159 | 12/1986 | Deitch et al. | 200/51.05 |

*Primary Examiner*—Joseph H. McGlynn
*Assistant Examiner*—David Pirlot
*Attorney, Agent, or Firm*—Merchant, Gould, Smith, Edell, Welter & Schmidt

[57] ABSTRACT

The present invention is directed to apparatus for maintaining good conductivity characteristics over time between a spring connector in contact with a connector housing having a plated substrate material. An insert is fitted into an appropriate space in the cast housing. The insert forms a gas tight seal with the housing at appropriate edges. The seal prevents oxidation of plating materials along the edges thereby maintaining good conductivity characteristics over time between the cast housing and the insert. The spring conductor and the insert are made from or plated with materials which do not form an oxide layer and thus maintain low contact resistance over time, thereby preserving good conductivity characteristics of the entire electrical path over time.

7 Claims, 8 Drawing Figures

ELECTRICAL CONNECTOR APPARATUS

FIELD OF THE INVENTION

The present invention is directed to the field of electrical connectors and, more particularly, to the use in a cast housing of an insert mode of a different material than the housing for a jack connector, the insert material having significantly better conductivity characteristics than the cast material relative to a spring conductor which yieldably makes electrical contact therewith.

BACKGROUND OF THE INVENTION

In a connector for receiving a plug, it is sometimes desirable to have one conductor in switching contact with another. Such switching relationship often occurs with a grounded connector housing. Since a connector housing is relatively large, it is expensive to make it from a high conductivity material. Furthermore, many of such materials are not easily cast. Thus, it is preferable to cast housings from materials such as bronze, brass, aluminum, steel, or zinc. However, since these materials corrode rather easily, the cast housing is then plated, oftentimes with nickel. The problem is that nickel along with other inexpensive corrosion-resistant, conductive-plating materials oxidize over time. The oxide is much less conductive than the original plating material. Hence, the contact resistance between a conductive spring and a plated housing often increases over time, often to a level unacceptable for many applications. The present invention solves this problem.

SUMMARY OF THE INVENTION

The present invention is directed to electrical apparatus including a frame, which in most applications is a housing. The frame includes a first conductive material forming a first conductive path wherein the frame has along the first conductive path a first edge. The apparatus further includes an insert with a contact surface and a second edge. The insert has a second conductive material continuous on and between the contact surface and the second edge. The frame further includes mechanism for holding the insert. The holding mechanism includes mechanism for forming a seal between the first and second edges for preventing passage of gas therebetween. In this way, oxidation of either the first and second materials along the first and second edges, respectively, is minimized. A spring forms a second conductive path. Insulating mechanism for supporting the spring with respect to the frame allows a contact portion of the spring to extend from the mechanism to yieldably contact the contact surface of the insert. The first and second materials may be different. Nevertheless, the seal forming mechanism maintains high conductivity between the first and second edges of the frame and the insert, while the spring forms a low contact resistance with the insert when the contact portion of the spring yieldably contacts the contact surface of the insert.

In another embodiment, the insulating mechanism is molded to a wall of the connector housing. The molding temperature of the insulation material is greater than the melting temperature of the second conductive material on the insert. In this way, the second conductive material flows during the molding of the insulating material and cools to form a bond with both the housing and the insert at the first and second edges, respectively, thereby insuring a gas tight seal and preventing the oxidizing layer from forming between the two elements.

This novel solution to a problem experienced with present connectors is more thoroughly discussed hereinafter with respect to a preferred embodiment as shown in the following drawings.

DETAILED DESCRIPTION OF THE PREFERRED EMBODIMENT

Figure 1:
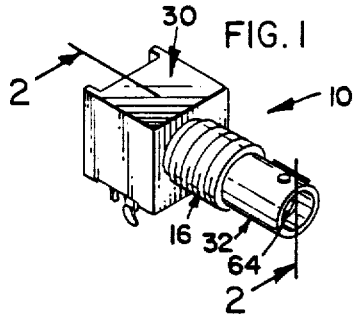
FIG. 1 is a perspective view of connector apparatus in accordance with the present invention.

Referring now to the drawings wherein like reference numerals designate identical or corresponding parts throughout the several views, and more particularly to FIG. 1, a jack type connector in accordance with the present invention is described generally by the numeral 10. Jack 10 receives a plug 12 shown partially in cross section in FIG. 2. Although the disclosure describes the preferred embodiment, it is understood that the particular jack and plug and details of each are representative of an environment in which the present invention as claimed may be used.

Figure 2:
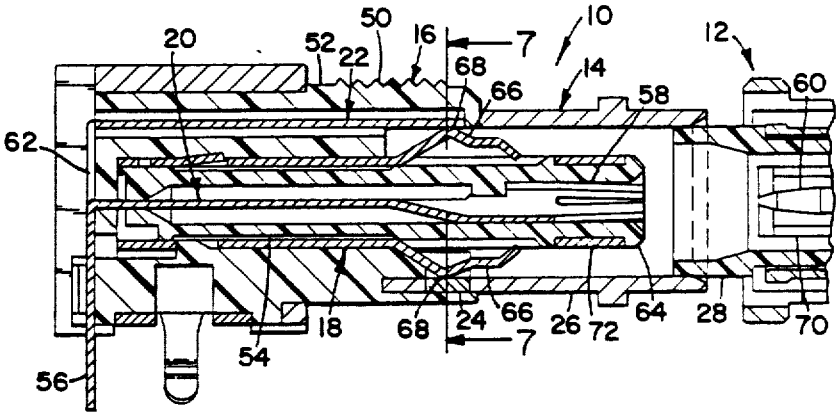
FIG. 2 is a cross-sectional view taken along line 2—2 of FIG. 1 and includes a portion of a typical plug.

As shown in FIG. 2, jack 10 includes a frame in the form of housing 14 to which insulating material is molded to form support 16 for spring conductor 18, as well as for central conductor 20 and auxiliary conductor 22. An insert 24 is fastened to wall 26 of housing 14. Spring conductor 18 is normally in contact with insert 24, a contact which is broken by insulator ring 28 of plug 12 on connection of plug 12 with jack 10.

Figure 3:
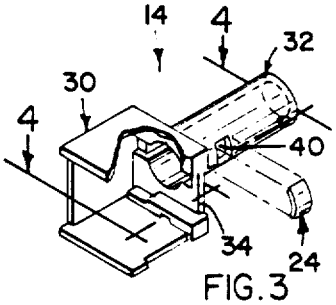
FIG. 3 is a perspective view of the housing of the connector of FIG. 1, partially broken away and having the insert exploded away.
Figure 4:
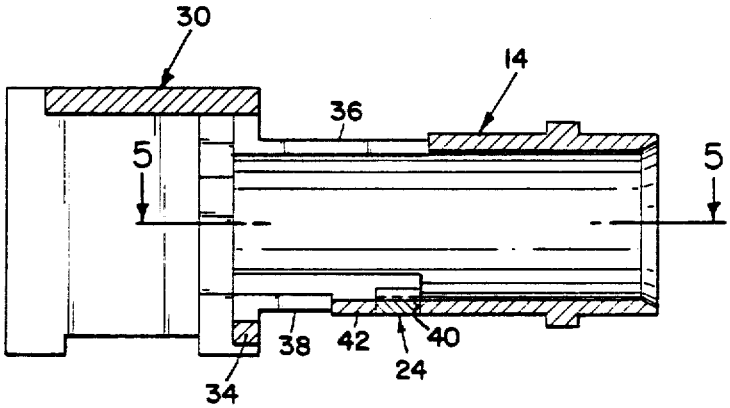
FIG. 4 is a cross-sectional view taken along line 4—4 of FIG. 3.
Figure 5:
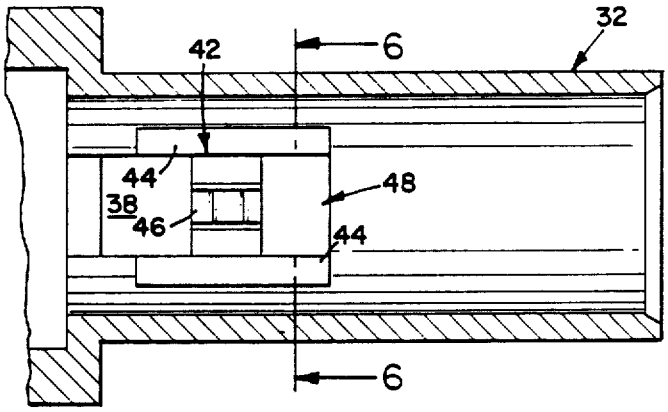
FIG. 5 is a cross-sectional view taken along line 5—5 of FIG. 4.
Figure 6:
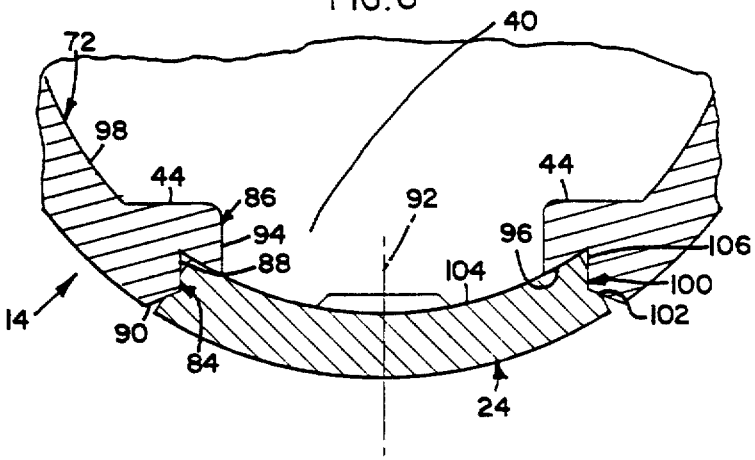
FIG. 6 is a cross-sectional view taken along line 6—6 of FIG. 5.
Figure 7:
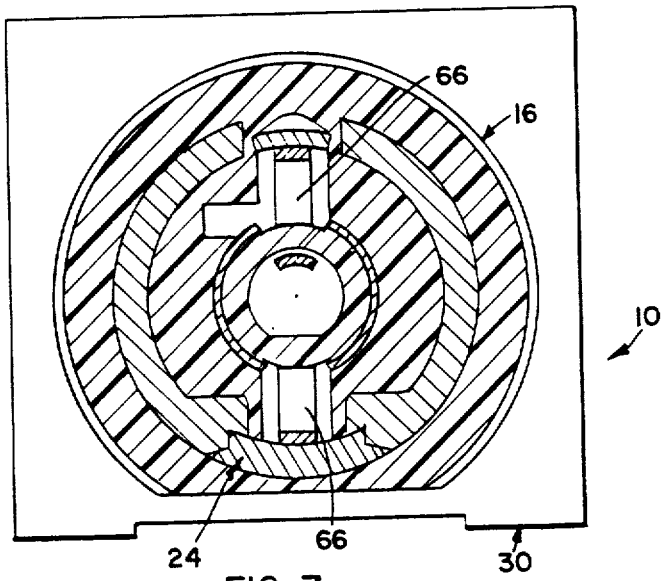
FIG. 7 is a cross-sectional view taken along line 7—7 of FIG. 2.

Housing 14, in the embodiment shown, includes a base 30 with a connected barrel 32 (see FIG. 3). Base 30 has a box-like shape with an open bottom and an open back. Barrel 32 is cylindrical and extends outwardly from a forward wall 34 of base 30. Barrel 32 includes an opening 36 along its upper portion adjacent to front wall 34 (see FIG. 4). Additional openings 38 and 40 are located in the bottom portion of barrel 32. Opening 38 is also adjacent to front wall 34. Opening 40 is spaced forwardly from opening 38. Cross member 42 which is a part of barrel 32 separates openings 38 and 40. As shown in FIGS. 5 and 6, ridges 44 extend along the axial direction of barrel 32 on opposite sides of openings 38 and 40 and cross member 42. In addition, cross member 42 includes a strengthening ridge 46 extending in the axial direction.

An insert 24 is pressed into opening 40 to completely fill opening 40. The outer surface of insert 24 generally conforms with the outer surface of barrel 32. Insert 24 is discussed more fully hereinafter.

Support 16 is made by molding an insulating material to include an outer part 52 molded to housing 14 and an inner part 54 for insertion into outer part 52. The insulating material for support 16 is formed to include designated cavities for the various conductors, but otherwise substantially fills base 30 and the rearward portion of barrel 32. During molding, the insulating material of outer part 52 flows through openings 36 and 38 and over the outer surface of insert 24 and is formed to have threads 50 about the rearward portion of barrel 32. Threads 50 mate with a shell (not shown) of plug 12 to hold plug 12 to jack 10. Inner part 54, which provides support between spring conductor 18 and central conductor 20, fits within outer part 52.

Central conductor 20 is received within inner part 54 of support 16. Central conductor 20 includes a lead 56 extending out the back of outer part 52 and along the back wall to protrude beneath base 30. The plug receiving end 58 of central conductor 20 has a cylindrical shape with a plurality of fingers for receiving probe conductor 60 of plug 12. Auxiliary conductor 22 is installed in a cavity of outer part 52 and has a lead 62 extending outwardly from outer portion 52 and downwardly along the rear wall to protrude beneath base 30. Spring conductor 18 is cylindrically shaped and also has a lead (not shown) extending outwardly through the back wall of outer portion 52 and downwardly to protrude beneath base 30. Spring conductor 54 extends to near the forward end 64 of inner portion 54 of support 16. A pair of cantilevered members 66 are in unity with spring conductor 18 near its rear end. Members 66 are formed as springs to include contact portions 68 which in the case of one member 66 contact insert 24, while in the case of the other member 66 contacts auxiliary conductor 22. Plug 12 includes an outer conductor 70 for making contact with the forward end 72 of spring conductor 18. Insulating ring 28 of plug 12 extends beyond probe conductor 60 and outer conductor 70 to contact and compress members 66 to open contact between the members 66 and insert 24 auxiliary conductor 22.

Housing 14 is preferably cast. Highly conductive materials such as gold, silver, copper, tin-lead alloy, etc., are either too expensive to use for a part the size of housing 14 or are too soft or are not easily cast or have some similar drawback. Preferably, housing 14 is cast from a material like zinc, brass, steel, bronze, etc. However, since these materials are susceptible to corrosion, it is further preferable to plate the casting. A corrosion-resistant material which may be plated at reasonable cost and which has acceptable conductivity characteristics is nickel. In addition, nickel has a high melting temperature so that it will not flow during molding of the insulating material to form support 16. In any case, although not necessary, it is evident that there are engineering and commercial reasons to form parts, such as housing 14, from a substrate material and then plate it with another material. Such procedure may also be advisable with respect to smaller parts or even all metallic parts of a particular assembly, such as jack 10.

Figure 8:
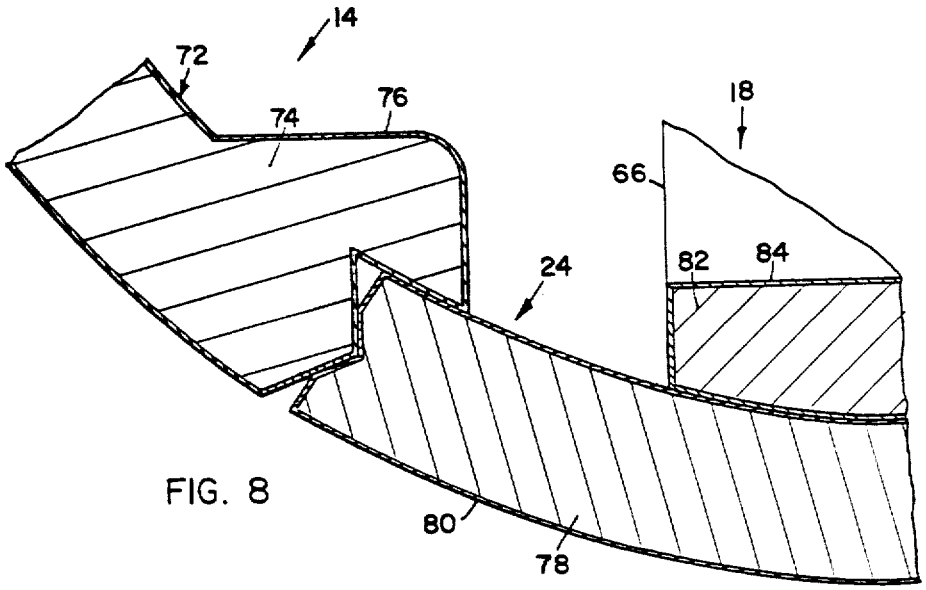
FIG. 8 is a detailed view of a portion of FIG. 7 showing also a portion of the spring conductor.

As shown in FIG. 8, housing 14 has a wall 72 formed of a first substrate material 74 which is plated with a first conductive material 76. In addition, insert 24 is shown to be formed from a second substrate material 78 which is plated with a second conductive material 80. Also, spring conductor 18 is formed of a third substrate material 82 which is plated with a third conductive material 84.

It has been found that if the plating material 76 of housing 14 is nickel, and if insert 24 is eliminated, that the spring force of cantilevered member 66 of spring conductor 18 does not prevent oxygen from reaching the nickel plating at the contact surface and that over time nickel oxide forms and contact resistance between spring conductor 18 and wall 72 of housing 14 increases. The present invention uses insert 24 in wall 72. Insert 24 preferably is formed of copper with a tin-lead plating. Spring conductor 18 is formed of bronze with a tin-lead plating. Tin-lead does not oxidize in the fashion of nickel. Consequently, the spring force of cantilevered member 66 continues to make good conductive contact over time with insert 24. It is important, however, for insert 24 to also make good conductive contact with wall 72 of housing 14 over time.

To prevent the oxide layer from forming at the interface between insert 24 and wall 72 of housing 14, a gas tight seal must be maintained. With reference to FIG. 6, housing 14 is formed to have a pair of opposite first edges 84 on opposite sides 86 of a radial plane 92. Edges 84 are indented in sides 86. Edges 84 have inner and outer segments 88 and 90. The inner and outer segments 88 and 90 form an interior angle less than 180 degrees such that the angle faces away from radial plane 92, on which insert 24 is centered. In order to completely face away from the indicated radial plane, inner segments 88 of first edges 84 are parallel to the radial plane or inclined away from it as the plane of inner segment 88 extends inwardly of wall 72. Preferably, inner segments 88 are parallel to radial plane 92 so insert 24 may be readily forced into opening 40. The sides 94 of ridges 44 facing radial plane 92 are spaced closer to radial plane 92 than first edges 84. A side 94 and an inner segment 88 of a first edge 84 are connected by a surface 96 which lies approximately along an imaginary extension of the inner surface 98 of wall 72.

Insert 24 is generally rectangular having dimensions which fill opening 40 in housing 14. Insert 24 is arcuate, however, to generally conform to the cylinderical wall 72 of barrel 32. Insert 24 has a pair of opposite second edges 100. Second edges 100 include indented portions 102 which have angles substantially the same as the interior angle formed by the inner and outer segments 88 and 90 of first edges 84. In this way, indented portions 102 mate with inner and outer segments 88 and 90. When indented portions 102 mate with inner and outer segments 88 and 90, the inner surface, which is also a contact surface 104 for cantilevered member 66 of spring conductor 18, is closely adjacent to surface 96 connecting side 94 and inner segment 88. The inner segments 88 of first edges 84 are separated by a first length. The mating inner segments 106 of second edges 100 are separated by a second length. The second length is greater than the first length so that the second edges of insert 24 apply a normal force against the first edges of housing 14, and there is a friction fit between inner segments 106 and 88 of first and second edges 84 and 100. In some cases, the friction fit is sufficient to form a gas tight seal to prevent an oxide layer and to maintain over time good continuity characteristics between insert 24 and wall 72 of housing 14. In the preferred embodiment as shown in the drawings, however, housing 14 is made from zinc plated with nickel and insert 24 is made from copper plated with a tin-lead alloy. Zinc, nickel and copper all have high melting temperatures. Tin lead, however, has a relatively low melting temperature. In particular, it is preferable to use a tin lead alloy having a melting temperature less than the molding temperature of the insulating material for forming support 16. In that case, when outer part 52 of support 16 is molded to housing 14, the tin lead alloy plated on insert 24 rewets and flows to bond to both insert 24 and first edge 84 of housing 14. In this situation, there is a much higher probability that a seal has been formed which will prevent oxygen from reaching the nickel and forming an oxide layer between the first and second edges along the contact regions of the mating inner segments 88 and 106.

In use, jack 10 is constructed by first molding housing 14 from an appropriate material, such as zinc. Housing 14 is then plated with an appropriate material, such as nickel. Insert 24 is formed from an appropriate material such as copper. Although there is less reason to plate insert 24 than housing 14, in the preferred embodiment insert 24 is plated with an appropriate material, such as a tin-lead alloy. As a first step in assembly, insert 24 is forced into opening 40 so that inner segments 106 of second edges 100 contact and force against inner segments 88 of first edges 84. Next, outer part 52 of support 16 is formed by molding an appropriate insulating material to housing 14 as described hereinbefore. Preferably, the molding temperature of the insulating material is greater than the melting temperature of the second conductive material 80 plated onto insert 24. In this way, as discussed hereinbefore, the tin-lead plate material 80 wets and flows to cool and bond with both housing 14 and insert 24 at portions of first and second edges 84 and 100.

Then the inner part of support 16, along with conductors 18, 20 and 22 are formed and appropriately assembled. In particular, spring conductor 18 having centilevered members 66 is installed between inner and outer parts 54 and 52 of support 16 so that the contact portion 68 of cantilevered member 66 contacts the contact surface 104 of insert 24.

With jack 10 assembled, plug 12 may be inserted and attached to the barrel 32 of jack 10. During insertion, insulator ring 28 contacts cantilevered members 66 and forces them to break contact with insert 24 and with auxiliary conductor 22. Since cantilevered member 66 and insert 24 are plated with material which do not readily oxidize, a low contact resistance between cantilevered member 66 and insert 48 is maintained over time.

Although the present disclosure has been described in terms of a complete plating of various parts with a conductive material, it is understood that in accordance with the present invention, only portions of parts need be conductive. That is, it is sufficient that a conductive material be a part of housing 14 to form a first conductive path between the inner segment 88 of first edge 84 and a ground connection or other electrical connection with jack 10. Also, it is necessary only for insert 24 to have a conductive material continuous between inner segment 106 of second edge 100 and contact surface 104. In this way, when the cantilevered spring member 66 of spring conductor 18, which forms a second conductive path, contacts contact surface 104, electrical continuity is made and maintained from member 66 through the contacting first and second edges to the first conductive path of housing 14.

These advantages and details of structure and function set forth hereinbefore with respect to the present invention have been described with reference to a preferred embodiment, but must be considered exemplary. It is understood that in the spirit of the present invention, changes may be made, especially in matters of shape, size and arrangement of parts, and that such changes are a part of the present invention to the full extent extended by the general meaning of the terms in which the appended claims are expressed.

What is claimed is:

1. Electrical apparatus, comprising:

a frame with a first conductive material forming a first conductive path, said frame along said first conductive path having a first edge;

an insert with a contact surface and a second edge, said insert including a second conductive material continuous on and between said contact surface and said second edge;

said frame including means for holding said insert, said holding means including means for forming a seal between said first and second edges for preventing passage of gas between said first and second edges, thereby minimizing any oxidation of one of said first and second materials along said first and second edges;

a conductor including a spring forming a second conductive path; and insulating means for supporting said conductor with respect to said frame, said spring having a contact portion extending from said insulating means to yieldably contact said contact surface of said insert;

whereby said first and second material may be different, said seal forming means maintaining high conductivity between said first and second material sat said first and second edges, said spring forming low contact resistance with said insert when said contact portion of said spring is yieldably contacting said contact surface of said insert.

2. Electrical jack apparatus for receiving a plug, said plug having a plug conductor, said apparatus comprising:

a housing having a wall including a first edge, said housing further including a first conductive material forming a first conductive path, said conductive path including said first edge;

an insert with a contact surface and a second edge, said insert including a second conductive material continuous on and between said contact surface and said second edge;

said housing including means for holding said insert, said holding means including means for forming a friction fit between said first and second edges;

a jack conductor forming a second conductive path, said jack conductor including a spring, said jack conductor for making electrical contact with said plug conductor; and means for supporting said jack conductor with respect to said housing, said supporting means including an electrically insulating material molded to said wall of said housing, said spring having a portion extending from said supporting means to yieldably contact said contact surface of said insert;

whereby said first and second materials may be different, said fit forming means maintaining high conductivity between said first and second materials at said first and second edges, said spring forming low contact resistance with said insert when said contact portion of said spring is yieldably contacting said contact surface of said insert.

3. Apparatus in accordance with claim 2 wherein said second material has a melting temperature less than the molding temperature of said molded insulating material, whereby said second material flows during the molding of said insulating material and cools to bond with both said housing and said insert at said first and second edges, respectively, thereby minimizing any oxidation of one of said first and second materials along said first and second edges.

4. Apparatus in accordance with claim 3 wherein said wall of said housing includes a pair of opposite first edges, said first edges being separated by a first length, said insert having a pair of opposite second edges separated by a second length, said second length being greater than said first length, said insert applying a normal force against said first edges of said housing to create said friction fit.

5. Apparatus in accordance with claim 4 wherein said wall is cylindrical and said insert is centered on a radial plane of said cylindrical wall, each of said first edges forming an angle no less than 90 degrees relative to a line perpendicular to said radial plane and extending between said first edges.

6. Electrical jack apparatus for receiving a plug, said plug having a plug conductor, said apparatus comprising:

a housing having a wall with an opening therein, said housing including a pair of opposite first edges on opposite sides of said opening, said first edges being separated by a first length, said housing being formed from a first substrate material plated with a first conductive material;

an insert having opposite second edges, said second edges being separated by a second length,s aid second length being greater than said first length, said insert being formed from a second substrate material plated with a second conductive material, said insert being forced into said opening in said wall so that each pair of first and second edges form a gas tight seal, thereby minimizing any oxidation of one of said first and second conductive materials along said first and second edges;

a jack conductor formed from a third conductive material, said jack conductor including a spring, said jack conductor for making electrical contact with said plug conductor; and means for supporting said jack conductor with respect to said housing, said supporting means including a part formed from an electrically insulating material molded to said wall of said housing, said spring having a portion extending from said supporting means to yieldably contact said insert, said molding temperature of a insulating material being greater than a melting temperature of said second conductive material, whereby said second conductive material flows during the molding of said insulating material and cools to bond with both said housing and said insert at said first and second edges, respectively;

and further whereby said first and second conductive materials may be different, said gas tight seal being formed between said first and second edges maintaining high conductivity between said first and second conductive materials at said first and second edges, said spring forming low contact resistance with said insert when said spring yieldably contacts said insert.

7. Apparatus in accordance with claim 6 wherein said wall is cylindrical and said insert is centered on a radial plane of said wall, said first edges having inner and outer segments, said inner and outer segments forming an interior first angle less than 180 degrees facing away from said radial plane, said second edges of said insert having indented portions including second angles substantially the same as said first angles of said first edges.

* * * * *

UNITED STATES PATENT AND TRADEMARK OFFICE

CERTIFICATE OF CORRECTION

PATENT NO. : 4,710,138

DATED : December 1, 1987

INVENTOR(S) : James D. Bradley and George B. Pfeffer

It is certified that error appears in the above-identified patent and that said Letters Patent is hereby corrected as shown below:

Column, 1 Line 63 "insulation" should be --insulating--.

Column 3, Line 34 "insert" should be --inserts--.

Column 4, Line 40 "cylinderical" should be --cylindrical--.

Column 5, Line 34 "centilevered" should be --cantalevered--.

Column 5, Line 44 "material" should be --materials--.

Column 6, Line 28 "material" should be --materials--.

Column 6, Line 31 "material sat" should be --materials at--.

Column 7, Line 32 "length,s aid" should be --length, said--.

Signed and Sealed this

Fifth Day of July, 1988

*Attest:*

*Attesting Officer*

DONALD J. QUIGG

*Commissioner of Patents and Trademarks*